US009541877B2

(12) United States Patent
Eda et al.

(10) Patent No.: US 9,541,877 B2
(45) Date of Patent: Jan. 10, 2017

(54) IMAGE FORMING APPARATUS, CONTROL METHOD OF CONTACTING/SEPARATING STATE OF COMPONENT

(71) Applicant: CANON KABUSHIKI KAISHA, Tokyo (JP)

(72) Inventors: Hiroyuki Eda, Moriya (JP); Yuichi Yamamoto, Abiko (JP); Naoto Watanabe, Abiko (JP); Hidenori Matsumoto, Kashiwa (JP); Takashi Fujimori, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/939,193

(22) Filed: Nov. 12, 2015

(65) Prior Publication Data

US 2016/0139552 A1 May 19, 2016

(30) Foreign Application Priority Data

Nov. 19, 2014 (JP) ..... 2014-234383
Oct. 16, 2015 (JP) ..... 2015-204646

(51) Int. Cl.
*G03G 15/00* (2006.01)
*G03G 15/01* (2006.01)

(52) U.S. Cl.
CPC ..... *G03G 15/553* (2013.01); *G03G 15/0136* (2013.01)

(58) Field of Classification Search
None
See application file for complete search history.

(56) References Cited

U.S. PATENT DOCUMENTS

2004/0009019 A1* 1/2004 Hosokawa ..... G03G 15/0131 399/301
2010/0124432 A1* 5/2010 Takayama ..... G03G 21/1853 399/110
2010/0150581 A1* 6/2010 Nakamura ..... G03G 15/553 399/18
2011/0064487 A1* 3/2011 Ichihashi ..... G03G 15/161 399/302
2014/0169804 A1 6/2014 Suzuki

* cited by examiner

*Primary Examiner* — Walter L Lindsay, Jr.
*Assistant Examiner* — Jas Sanghera
(74) *Attorney, Agent, or Firm* — Fitzpatrick, Cella, Harper & Scinto

(57) ABSTRACT

The image forming apparatus comprises a photosensitive drum which is replaceable, an intermediate transfer belt unit which is brought into contact with the photosensitive drum to operate and which is replaceable, and a separation motor configured to move the intermediate transfer belt unit in a direction toward the photosensitive drum and in a direction away from the photosensitive drum. The image forming apparatus causes the separation motor to separate the intermediate transfer belt unit and the photosensitive drum from each other in a case where at least one of the photosensitive drum and the intermediate transfer belt unit reaches the replacement timing when the image forming apparatus shifts to a low-power state in which power consumption of the image forming apparatus is suppressed compared with that of the image forming apparatus in a normal operation.

18 Claims, 8 Drawing Sheets

| | COLOR PRIORITY MODE | MONOCHROME PRIORITY MODE |
|---|---|---|
| STANDBY STATE | ALL-COLOR CONTACTING | ONE-COLOR CONTACTING |
| LOW-POWER STATE | ALL-COLOR CONTACTING | ONE-COLOR CONTACTING |
| LOW-POWER STATE (REPLACEMENT TIMING OF PHOTOSENSITIVE DRUM OF K OR INTERMEDIATE TRANSFER BELT) | ALL-COLOR SEPARATING | ALL-COLOR SEPARATING |
| LOW-POWER STATE (REPLACEMENT TIMING OF ANY OF PHOTOSENSITIVE DRUMS OF Y, M, AND C) | ALL-COLOR SEPARATING | ONE-COLOR CONTACTING |

FIG. 6

IMAGE FORMING APPARATUS, CONTROL METHOD OF CONTACTING/SEPARATING STATE OF COMPONENT

BACKGROUND OF THE INVENTION

Field of the Invention

The present disclosure relates to an image forming apparatus such as a copy machine, a multifunction peripheral, etc. In particular, the present disclosure relates to technology to replace a component which is replaceable in the image forming apparatus.

Description of the Related Art

Some image forming apparatuses comprise a photosensitive drum on which toner images are formed, and comprise an intermediate transfer belt to which toner images are transferred from the photosensitive drum. In a case where the toner images are transferred to the intermediate transfer belt from the photosensitive drum, a transfer roller is brought into pressure contact with the photosensitive drum through the intermediate transfer belt. It is often the case that the photosensitive drum or a unit including the photosensitive drum and the intermediate transfer belt or a unit including the intermediate transfer belt of the image forming apparatus of this kind are components which are individually and independently replaceable. In the following, the intermediate transfer belt or the unit including the intermediate transfer belt is referred to as "intermediate transfer belt unit".

Some image forming apparatuses are capable of setting "color priority mode" and "monochrome priority mode" to reduce standby time at the time of image formation. When it is expected that color image formation is mainly used, "color priority mode" is set. In the color priority mode, the image forming apparatus brings all the photosensitive drums into contact with the intermediate transfer belt in a standby state. When it is expected that monochrome image formation is mainly used, "monochrome priority mode" is set. In the monochrome priority mode, the image forming apparatus brings only the black photosensitive drum into contact with the intermediate transfer belt in the standby state. A user can switch setting between the color priority mode and the monochrome priority mode.

In a case where replacement of the photosensitive drum or the intermediate transfer belt unit is carried out with the photosensitive drum brought into contact with the intermediate transfer belt, friction is caused therebetween. Due to this, deterioration is caused at parts where the photosensitive drum contacts with the intermediate transfer belt. Thereby, when replacement of the photosensitive drum or the intermediate transfer belt unit is carried out, the two of them need to be separated. The United States Patent Application Publication No. US2014/0169804 discloses a technology that at the time of replacing the photosensitive drum or the intermediate transfer belt, all the photosensitive drums are separated from the intermediate transfer belt in a standby mode.

In a case where the photosensitive drum is manually separated from the intermediate transfer belt, a mechanism for the manual separation is required. This increases the number of parts and the manufacturing cost. Further, in a case where the photosensitive drum is automatically separated from the intermediate transfer belt at the time of replacement, the photosensitive drum will be brought into contact with and separated from the intermediate transfer belt. Such operations will be performed every time the image formation is started and ended, which will be continued till the user carries out the replacement. Due to this, the image forming processing is time-consuming process. Also, due to unnecessary contact of the photosensitive drum with the intermediate transfer belt and unnecessary separation of the photosensitive drum from the intermediate transfer belt, noise is caused. Further, in a case where the photosensitive drum other than the black photosensitive drum reaches replacement timing in the monochrome priority mode, all the photosensitive drums are uniformly separated from the intermediate transfer belt. Thereby when performing next print job, unnecessary contacting operation occurs.

An image forming apparatus which can reduce any unnecessary mechanism or operation while allowing replacement of components which are replaceable, such as the photosensitive drum, the intermediate transfer belt, etc., is thus required.

SUMMARY OF THE INVENTION

The image forming apparatus of the present disclosure comprises: a first component which is replaceable; a second component which is replaceable and configured to operate in contact with the first component; a driving unit configured to move at least one component of the first component and the second component in a direction in which the first component and the second component are close to each other and in a direction in which the first component and the second component are away from each other; a storing unit configured to store information representing the replacement timing of the first component and the second component; and a control unit configured to cause the driving unit to separate the second component and the first component from each other in a case where the information represents that at least one of the first component and the second component has reached the replacement timing and the image forming apparatus shifts to a low-power state in which power consumption of the image forming apparatus is suppressed compared with that of the image forming apparatus in a normal operation.

Further features of the present invention will become apparent from the following description of exemplary embodiments (with reference to the attached drawings).

BRIEF DESCRIPTION OF THE DRAWINGS

FIG. 6 is a diagram explaining a contacting state and a separating state of the photosensitive drum.

DESCRIPTION OF THE EMBODIMENTS

In the following, embodiments are described in detail with reference to the accompanying drawings.

Figure 1:
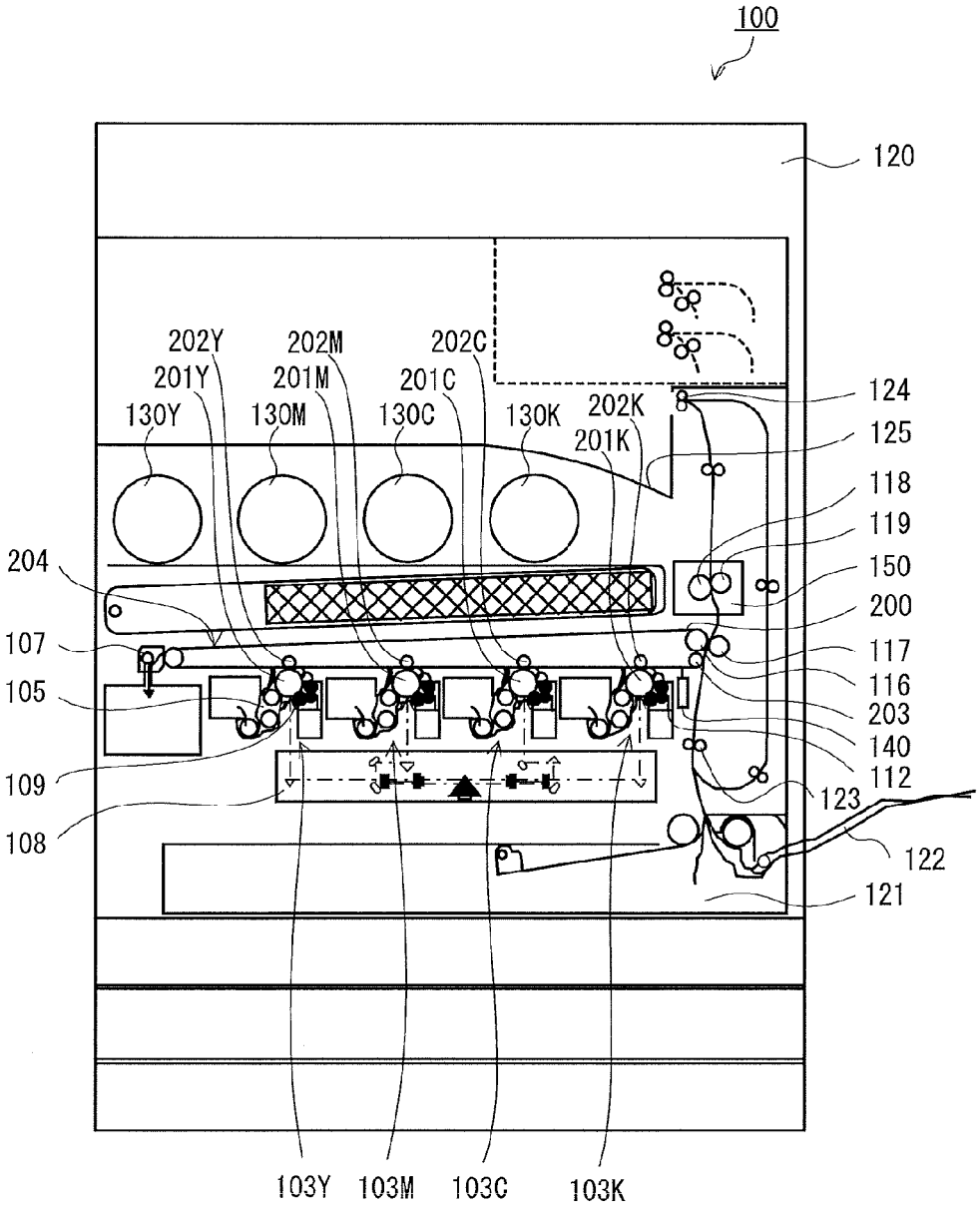
FIG. 1 is a configuration diagram of an image forming apparatus.

FIG. 1 is a configuration diagram of an electrophotographic image forming apparatus 100 according to this embodiment. The image forming apparatus 100 is capable of forming images consisting of a plurality of colors. Also, the image forming apparatus 100 is capable of forming full color images and monochromatic images. A document reading unit 120 is provided on top of the image forming apparatus 100. The document reading unit 120 reads an image of the document and generates image information which represents the image read.

To form the image of each color, i.e., yellow (Y), magenta (M), cyan (C), and black (K), the image forming apparatus 100 comprises process cartridges 103Y, 103M, 103C and 103K, which respectively correspond to each color in order. Each process cartridge 103Y, 103M, 103C and 103K is aligned horizontally at fixed intervals to form the in-line type image forming apparatus 100. Each process cartridge 103Y, 103M, 103C and 103K is capable of being attached to and detached from the image forming apparatus 100 independently. It is noted that the letters Y, M, C, and K are attached at the end of the reference numerals when it is necessary to distinguish the process cartridge for each color. Otherwise, such letters are not attached. The same applies to other components which are provided for each color.

The image forming apparatus 100 comprises a laser exposure unit 108 below the process cartridges 103Y, 103M, 103C and 103K. The laser exposure unit 108 comprises a light emitting unit which emits light corresponding to the image information which represents images to be formed. The image forming apparatus 100 comprises an intermediate transfer belt unit 204 above the process cartridges 103Y, 103M, 103C and 103K. The intermediate transfer belt unit 204 includes an intermediate transfer member of an intermediate transfer belt 200. The intermediate transfer belt unit 204 is capable of being attached to and detached from the image forming apparatus 100.

The process cartridge 103 comprises a photosensitive drum 201 which is a drum-type photoreceptor. The process cartridge 103 comprises a primary charger 109, a developing device 105, and a drum cleaner 112 around the photosensitive drum 201.

The photosensitive drum 201 is an organic photoconductor which is negatively charged. The photosensitive drum 201 comprises a photoconductive layer on an aluminum drum base and is rotated and driven by a driving device (not shown) at a predetermined process speed. The primary charger 109 uniformly charges the surface of the photosensitive drum 201 to a predetermined potential of negative polarity by charging bias voltage applied from a charging bias power source (not shown). An electrostatic latent image according to the image information is formed on the photosensitive drum 201 by exposing its surface, after charging of the same, with the laser exposure unit 108. The developing device 105, in which a toner as a developer is installed, adheres the toner to the electrostatic latent image formed on the photosensitive drum 201 to perform development to form a toner image. A toner image of a different color is formed for each of a plurality of photosensitive drums 201. A developing device 105Y forms yellow toner image by adhering a yellow toner on a photosensitive drum 201Y. A developing device 105M forms magenta toner image by adhering a magenta toner on a photosensitive drum 201M. A developing device 105C forms cyan toner image by adhering a cyan toner on a photosensitive drum 201C. A developing device 105K forms black toner image by adhering a black toner on a photosensitive drum 201K. The toner images of each color are transferred to the intermediate transfer belt 200. The drum cleaner 112 comprises a cleaning blade. With the cleaning blade, the drum cleaner 112 removes toner which remains in the photosensitive drum 201 after the transfer.

In addition to the intermediate transfer belt 200, the intermediate transfer belt unit 204 comprises rollers such as primary transfer rollers 202Y, 202M, 202C, 202K, a stretching roller 203, and a driving roller 116, and a gear for rotating the driving roller 116 (not shown) etc. A plurality of the primary transfer rollers 202Y, 202M, 202C and 202K are provided to respectively correspond to the photosensitive drums 201Y, 201M, 201C and 201K one to one. The primary transfer roller 202 is positioned to face the corresponding photosensitive drum 201 interposing the intermediate transfer belt 200 therebetween. The driving roller 116 is rotated and driven by a driving gear (not shown). By the rotation of the driving roller 116, the intermediate transfer belt 200 rotates in counterclockwise direction of FIG. 1. The driving roller 116 also functions as a secondary transfer opposed roller.

The primary transfer roller 202 is biased on the intermediate transfer belt 200 side with a bias mechanism (not shown). The primary transfer roller 202 is operable to move to bring the intermediate transfer belt 200 into contact with the photosensitive drum 201 and to separate the intermediate transfer belt 200 from the photosensitive drum 201. In a state in which the intermediate transfer belt 200 is brought into contact with the photosensitive drum 201 by the primary transfer roller 202, the toner image formed on the photosensitive drum 201 is transferred to the intermediate transfer belt 200. By overlappingly transferring the toner images from the photosensitive drums 201Y, 201M, 201C and 201K to the intermediate transfer belt 200, full color toner image is formed on the intermediate transfer belt 200.

A secondary transfer roller 117 is positioned to face the driving roller 116 interposing the intermediate transfer belt 200 therebetween. The driving roller 116 and the secondary transfer roller 117 form a secondary transfer unit. By interposing the intermediate transfer belt 200 and a sheet on which the image is formed between the secondary transfer roller 117 and the driving roller 116, the secondary transfer roller 117 transfers the toner image formed on the intermediate transfer belt 200 to the sheet. The sheet is conveyed to the secondary transfer unit from a feeding cassette 121 or a manual feed tray 122 through a registration roller 123. A fixing device 150, having a fixing roller 118 and a pressure roller 119, is provided on a downstream side in the conveyance direction of the sheet of the secondary transfer unit.

In the image forming apparatus 100, a toner container 130, in which toner for supplying to the developing device 105 is stored, is attachably/detachably mounted above the intermediate transfer belt unit 204. The toner containers 130Y, 130M, 130C and 130K are mounted for each color. The toner of each color is supplied to the developing devices 105Y, 105M, 105C and 105K of the corresponding color.

When the print job is started, the image forming apparatus 100 rotates and drives the photosensitive drum 201 at predetermined process speed. The surface of the photosensitive drum 201 is uniformly charged to the negative polarity by the primary charger 109. The laser exposure unit 108 exposes photosensitive drum 201 according to the image information generated in the document reading unit 120 or the image information input from other device to form the electrostatic latent images. Developing bias voltage which is the same polarity as the charged polarity of the photosensitive drum 201 (negative polarity) is applied to the developing device 105. Toner is then attached to the electrostatic latent images on the photosensitive drum 201 to form the toner images.

A primary transfer bias voltage (with polarity reverse to the toner, i.e., positive polarity) is applied to the primary transfer roller 202 to bring the intermediate transfer belt 200 into pressure contact with the photosensitive drum 201. Due to this, the toner image formed on the photosensitive drum 201 is primarily transferred to the intermediate transfer belt 200 being driven.

Such operation is performed in parallel with respect to each color of yellow, magenta, cyan and black. By successively overlapping the toner images of each color on the intermediate transfer belt 200, full color toner image is formed on the intermediate transfer belt 200. The toner image having formed on the intermediate transfer belt 200 is transferred to the secondary transfer unit. In accordance with a timing at which a leading edge of the toner image moves to the secondary transfer unit, the sheet which is fed from the feeding cassette 121 or the manual feed tray 122 passes through a conveying path and is conveyed to the secondary transfer unit through the registration roller 123. The full color toner images are transferred to the sheet conveyed to the secondary transfer unit by the secondary transfer roller 117. A secondary transfer bias voltage (with polarity reverse to the toner, i.e., positive polarity) is applied to the secondary transfer roller 117. A transfer cleaner 107 removes residual toner remaining on the intermediate transfer belt 200 after the transfer.

The sheet having the toner image transferred is conveyed to the fixing device 150 to thermally fix the toner image at a fixing nip portion which lies between the fixing roller 118 and a pressurizing roller 119. The sheet is then discharged to a delivery tray 125 by the discharge roller 124. The delivery tray 125 is provided at an upper part of the image forming apparatus 100 main body. A series of the image forming processing by the print job ends in this way.

It is noted that a photosensor 140 is disposed below the intermediate transfer belt unit 204. The photosensor 140 is used to detect a patch image, which is formed on the intermediate transfer belt 200 and used to measure density. The photosensor 140 is used to detect density information and misregistration. This is done by irradiating light on the intermediate transfer belt 200 and detecting reflection light from the patch image formed on the intermediate transfer belt 200 by the photosensitive drum 201.

Figure 2:
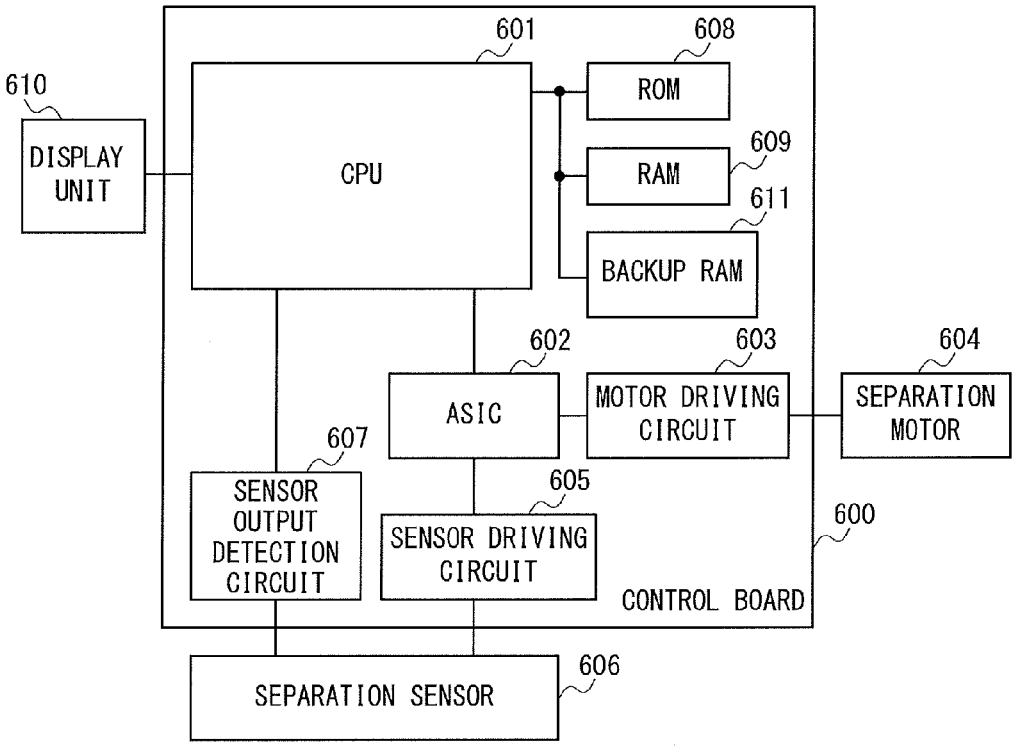
FIG. 2 is a configuration diagram a control system.

FIG. 2 is a configuration diagram of a control system which controls an operation of the image forming apparatus 100. Here, description is given with regard to a configuration which performs control relating to movement of the primary transfer roller 202 and description is omitted with regard to configuration which realizes other feature of the image forming apparatus 100. The control system comprises a control board 600, a separation motor 604, a separation sensor 606, and a display unit 610. The control system is incorporated in the image forming apparatus 100.

The control board 600 comprises a central processing unit (CPU) 601, a read only memory (ROM) 608, and a random access memory (RAM) 609. The CPU 100 controls an entire operation of the image forming apparatus 100 by reading computer program stored in the ROM 608 and executing the computer program using the RAM 609 as a work area. The control board 600 comprises a backup RAM 611. Power is supplied to the backup RAM 611 from a backup battery (not shown). The backup RAM 611 stores the number of sheets (the integrated number of printings) having the images formed by the image forming apparatus 100.

The control board 600 comprises an application specific integrated circuit (ASIC) 602 and a motor driving circuit 603 for controlling the separation motor 604 used to move the primary transfer roller 202. The CPU 601 drives and controls the separation motor 604 through the ASIC 602 and the motor driving circuit 603 to individually move the primary transfer roller 202 and the stretching roller 203. By moving the primary transfer roller 202 and the stretching roller 203, the control board 600 brings the intermediate transfer belt 200 into contact with the photosensitive drum and separates the intermediate transfer belt 200 from the photosensitive drum 201.

To control the separation sensor 606 which detects contacting/separating state of the intermediate transfer belt 200 and the photosensitive drum 202, the control board 600 comprises a sensor driving circuit 605 and a sensor output detection circuit 607. It is noted that, in a contacting state, the intermediate transfer belt 200 is brought into contact with the photosensitive drum 201, and, in a separating state, the intermediate transfer belt 200 is separated from the photosensitive drum 201. The separation sensor 606 is a photosensor which is provided for each primary transfer roller 202 and arranged to switch between transmission and shielding depending on a position of the corresponding primary transfer roller 202. In a case where the contacting/separating state of the intermediate transfer belt 200 and the photosensitive drum 202 is detected, the CPU 601 causes the separation sensor 606 to emit light through the ASIC 602 and the sensor driving circuit 605. The separation sensor 606 detects the contacting/separating state depending on a light receiving state of the reflection light. The CPU 601 receives the detection result of the separation sensor 606 through the sensor output detection circuit 607. Based on the detection result received, the CPU 601 can determine the contacting/separating state of the intermediate transfer belt 200 and the photosensitive drum 201 to detect the position of the primary transfer roller 202.

The display unit 610 is provided on an operation panel (not shown) and displays various information. The operation panel is a user interface which receives various instructions from the user. It is noted that, in a case where there is no operation to the operation panel by the user for a predetermined time, the CPU 601 enters a low-power state by interrupting signals to the motor driving circuit 603 and the sensor driving circuit 605 through the ASIC 602.

Figures 3A, 3B, 3C:
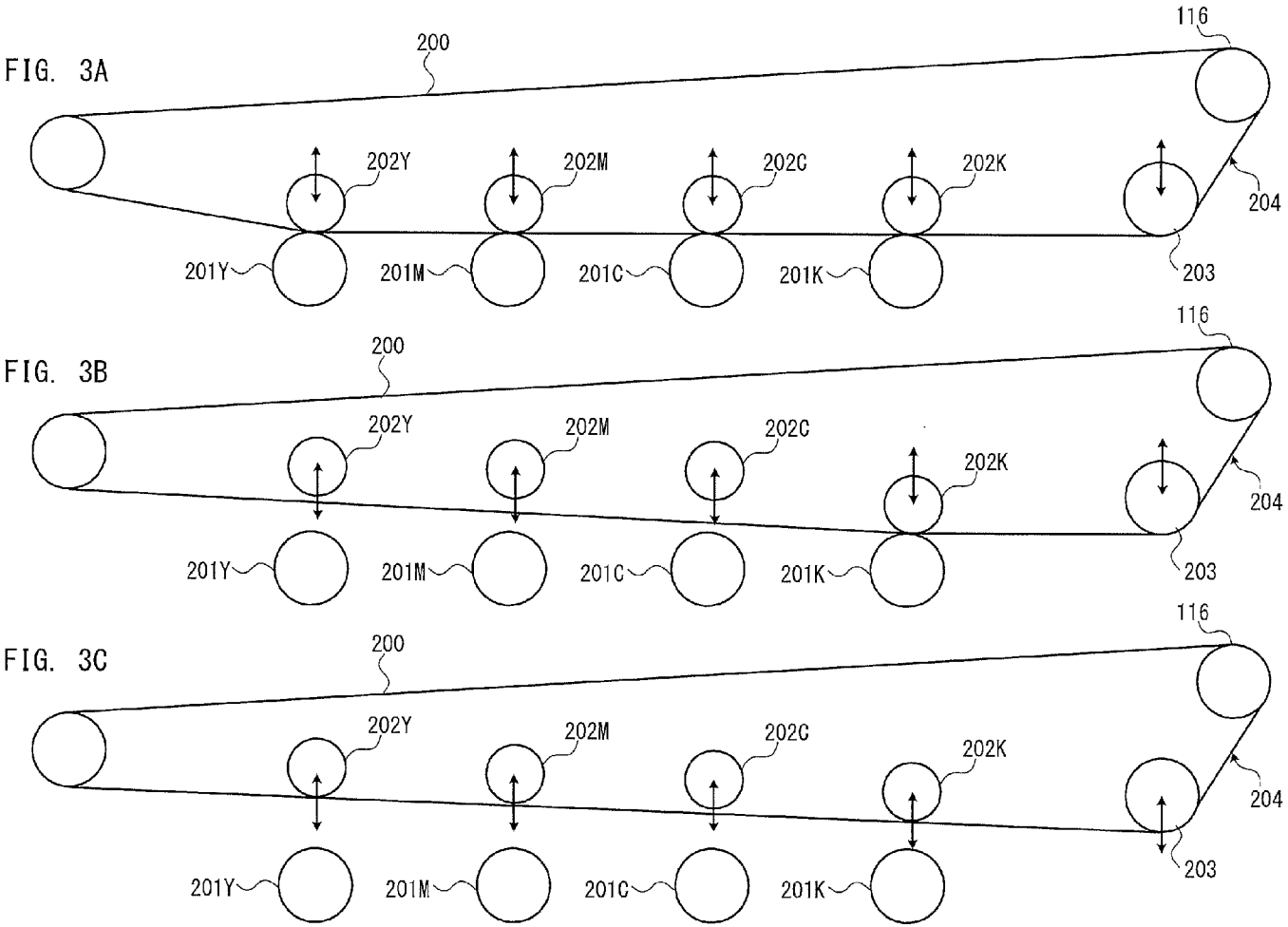
FIGS. 3A to 3C are diagrams explaining a contacting state and a separating state.

FIGS. 3A to 3C are diagrams explaining the contacting state and the separating state of the intermediate transfer belt 200 and the photosensitive drum 201. FIG. 3A shows a state in which the intermediate transfer belt 200 is brought into contact with all the photosensitive drums 201Y, 201M, 201C and 201K (hereinafter referred to as "all-color contacting state"). FIG. 3B shows a state in which the intermediate transfer belt 200 is brought into contact with the photosensitive drum 201K and is separated from the photosensitive drums 201Y, 201M, and 201C (hereinafter referred to as "one-color contacting state"). FIG. 3C shows a state in which the intermediate transfer belt 200 is separated from all the photosensitive drums 201Y, 201M, 201C and 201K (hereinafter referred to as "all-color separating state").

The separation motor 604 separately moves the primary transfer roller 202 and the stretching roller 203 in an arrow direction in FIGS. 3A to 3C. As mentioned, the primary transfer roller 202 is biased by the bias mechanism to the corresponding photosensitive drum 201. With the bias mechanism and the separation motor 604, the primary transfer roller 202 separately shifts in a direction toward to the photosensitive drum 201 or in a direction away from the photosensitive drum 201. As a result, the intermediate transfer belt 200 is brought into one of the following states, i.e., all-color contacting state, one-color contacting state or all-color separating state. It is noted that, in the present embodiment, it is the separation motor 604 that drives the primary transfer roller 202 and the stretching roller 203 to come closer to the photosensitive drum 201 or separate from the photosensitive drum 201. Alternatively, the separation motor 604 may be configured to drive the photosensitive drum 201. Further, the separation motor 604 may be configured to drive the photosensitive drum 201 with the primary transfer roller 202 and the stretching roller 203.

As shown in FIG. 3A, in the all-color contacting state, the primary transfer roller 202 and the stretching roller 203 are biased on the photosensitive drum 201 side. Due to this, all the photosensitive drums 201Y, 201M, 201C and 201K are brought into contact with the intermediate transfer belt 200 so that the toner images can be transferred to the intermediate transfer belt 200 from all the photosensitive drums 201Y, 201M, 201C and 201K. The full-color toner images are formed on the intermediate transfer belt 200. As mentioned, the all-color contacting state is a state in which the color priority mode is selected. In a state in which the color priority mode is selected, the intermediate transfer belt 200 stands by in the all-color contacting state.

As shown in FIG. 3B, in the one-color contacting state, the primary transfer roller 202K and the stretching roller 203 are biased on the photosensitive drum 201 side. Due to this, the intermediate transfer belt 200 is brought into contact only with the photosensitive drum 201K. Other primary transfer rollers 202Y, 202M, and 202C move in a direction opposite to the photosensitive drum 201 by the separation motor 604. As a result, the intermediate transfer belt 200 is separated from the photosensitive drums 201Y, 201M, and 201C. Due to this, the monochrome toner images are formed on the intermediate transfer belt 200. As described, in the monochrome priority mode, the intermediate transfer belt 200 is brought into the one-color contacting state. In a state in which the monochrome priority mode is selected, the intermediate transfer belt 200 stands by in the one-color contacting state. In the one-color contacting state, the photosensitive drums 201Y, 201M, and 201C for forming the color images are separated from the intermediate transfer belt 200. In addition, the photosensitive drums 201Y, 201M, and 201C do not rotate, thus, deterioration is suppressed.

As shown in FIG. 3C, in the all-color separating state, the primary transfer roller 202 and the stretching roller 203 move in a direction opposite to the photosensitive drum 201 by the separation motor 604. Due to this, the intermediate transfer belt 200 is separated from the photosensitive drums 201Y, 201M, 201C, and 201K. Thus, no toner image is transferred to the intermediate transfer belt 200. As described, the all-color separating state is a state in which no transfer of the toner image from the photosensitive drums 201Y, 201M, 201C, and 201K to the intermediate transfer belt 200 becomes possible.

In the all-color separating state, even the intermediate transfer belt unit 204 or the photosensitive drum 201 is replaced, no friction is caused between the intermediate transfer belt 200 and the photosensitive drum 201. On the other hand, at the time of the image formation, the primary transfer roller 202 is brought into the all-color contacting state or one-color contacting state.

Figure 4:
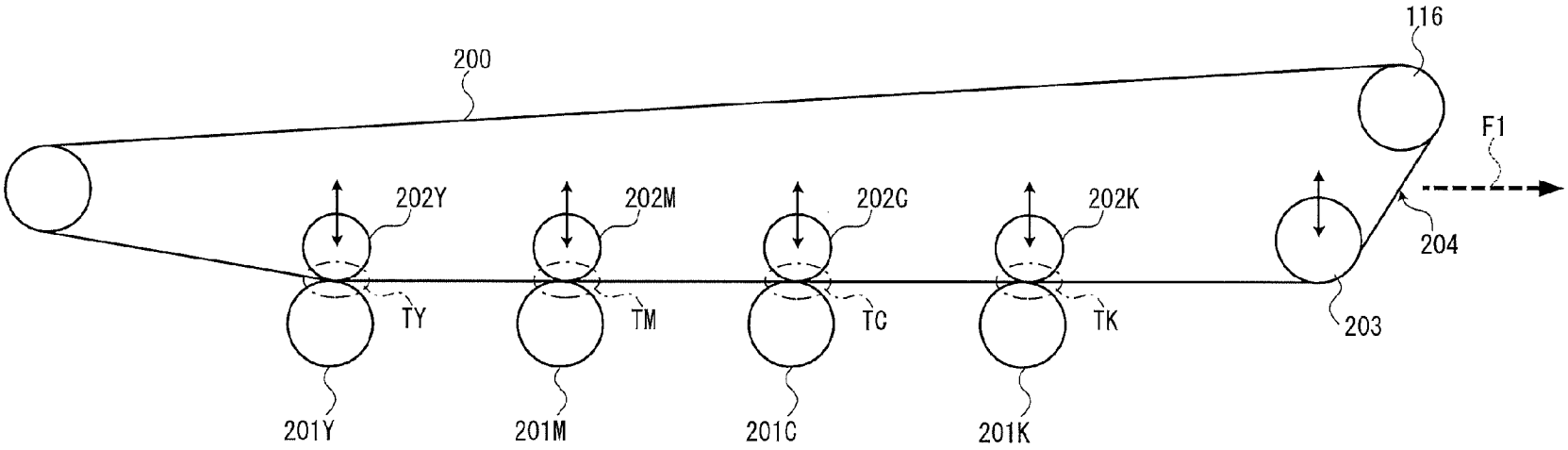
FIG. 4 is a diagram explaining direction to which the intermediate transfer belt unit is attached and detached.
Figure 5A:
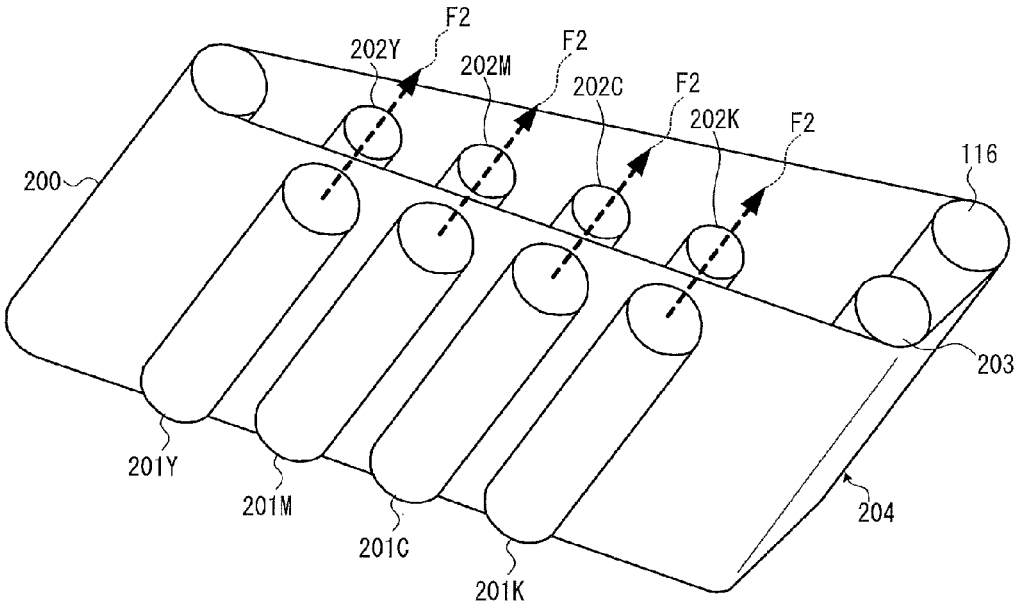
FIGS. 5A and 5B are diagrams explaining direction to which the photosensitive drum is attached and detached.
Figure 5B:
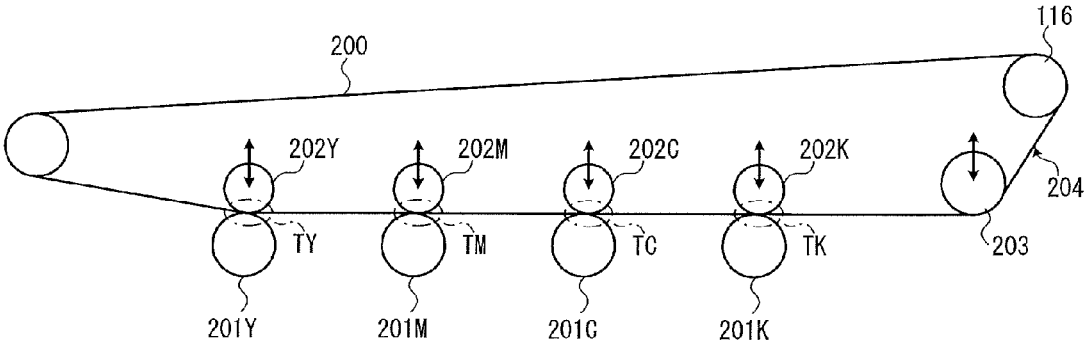

FIG. 4 is a diagram explaining a direction to which the intermediate transfer belt unit 204 is attached and detached. FIGS. 5A and 5B are diagrams explaining a direction to which the photosensitive drum 201 is attached and detached. The intermediate transfer belt unit 204 and the photosensitive drum 201 are capable of separately and independently being attached to and detached from the image forming apparatus 100. The intermediate transfer belt unit 204 and the photosensitive drum 201 are replaceable components.

The intermediate transfer belt unit 204 is pulled out from the image forming apparatus 100 main body in an arrow F1 direction (see FIG. 4). The arrow F1 direction is a direction which is vertical to an axis of the rotation axis of the photosensitive drum 201 and parallel to the belt conveying direction between the photosensitive drums 201K and 201Y. The intermediate transfer belt unit 204 is pressed in a direction opposite to the arrow F1 and mounted on the image forming apparatus 100 main body. In a case where the attachment/detachment of the intermediate transfer belt unit 204 is carried out in the all-color contacting state as shown in FIG. 4, friction is caused at parts TY, TM, TC, and TK, where the intermediate transfer belt 200 is brought into contact with the photosensitive drum 201, which causes deterioration of the two of them.

FIG. 5A is a diagram showing the intermediate transfer belt unit 204 and the photosensitive drum 201 in the all-color contacting state viewed from below. FIG. 5B is a diagram showing the photosensitive drum 201 viewed from a direction of an axis of rotation of the photosensitive drum 201. The photosensitive drum 201 is pulled out in an arrow F2 direction (FIG. 5A) from the image forming apparatus 100 main body. The arrow F2 direction is a direction of an axis of rotation of the photosensitive drum 201. The photosensitive drum 201 is pressed in a direction opposite to the arrow F2 direction and mounted on the image forming apparatus 100 main body. As shown in FIGS. 5A and 5B, in a case where the photosensitive drum 201 is mounted in the all-color contacting state, friction is caused at parts TY, TM, TC, and TK, where the intermediate transfer belt 200 is brought into contact with the photosensitive drum 201, which causes deterioration of the two of them.

As mentioned, by the position displacement of the primary transfer roller 202 and the stretching roller 203, the intermediate belt 200 is brought into contact with the photosensitive drum 201 and is separated from the photosensitive drum 201. However, it is the photosensitive drum 201 that causes a problem regarding the friction with the intermediate transfer belt 200. Thereby, in the present specification, to describe the contacting state and the separating state of the intermediate transfer belt 200 and the photosensitive drum 201, an expression of "contacting/separating state of the photosensitive drum 201" is used focusing on the photosensitive drum 201.

In the color priority mode and the monochrome priority mode, the image forming apparatus 100 switches the contacting/separating state of the photosensitive drum 201 between the standby state and the low-power state. The standby state is a state in which the image formation is not performed and the image forming apparatus 100 waits for an input of print job. The low-power state is a state in which power consumption of the image forming apparatus is lower than that of the image forming apparatus in the standby state and power supply to a part of the circuit of the device is discontinued. Also, even in a case where replacement of at least one of the intermediate transfer belt 200 and the photosensitive drum 201 needs to be carried out, the image forming apparatus 100 switches between the contacting/separating state of the photosensitive drum 201.

FIG. 6 is a diagram explaining contacting/separating state of the photosensitive drum 201 in a combination of each mode. FIG. 6 represents the states of the photosensitive drum 201 and the intermediate transfer belt 200 when the image forming apparatus 100 is in the color priority mode and monochrome priority mode. Depending on whether the image forming apparatus 100 is in the standby state or low power state, the photosensitive drum 201 and the intermediate transfer belt 200 are brought into all-color contacting state, one-color contacting state, or all-color separating state.

When the image forming apparatus 100 is in the color priority mode, all the photosensitive drums 201 are brought into contact with the intermediate transfer belt 200 in the standby state. It is expected that, in the color priority mode, color image forming processing is mainly executed. So, by bringing into the all-contacting state in the standby state, downtime caused by the contacting operation in the print job can be reduced. When the image forming apparatus 100 is in a monochrome priority mode, only the photosensitive drum 201K is brought into contact with the intermediate transfer belt 200 in the standby state. It is expected that, in the monochrome priority mode, monochrome image forming processing is mainly executed. So, by bringing into the one-color contacting state, downtime caused by the separating operation in the print job can be reduced.

If neither the intermediate transfer belt 200 nor the photosensitive drum 201 reaches the replacement timing, when shifting to the low-power state in any of the color priority modes and monochrome priority mode, the contacting/separating state remains the same. Due to this, contacting/separating operation will not be performed every time the image forming apparatus 100 shifts to the low-power state or recovers from the low-power state, which prevents the occurrence of noise accompanied by the operation.

If at least one of the intermediate transfer belt 200 and the photosensitive drum 201K reaches the replacement timing, the image forming apparatus 100, in either the color priority mode or monochrome priority mode, separates all the photosensitive drums 201 from the intermediate transfer belt 200 when shifting to the low-power state. If at least one of the intermediate transfer belt 200 and the photosensitive drum 201K reaches the replacement timing, it is expected that replacement work is carried out even if the image forming apparatus is in the low-power state. So, by bringing the image forming apparatus into the all-color separating state, the image forming apparatus 100 avoids occurrence of friction between the two of them caused at the time of replacement.

If at least one of the photosensitive drums 201Y, 201M, and 201C reaches the replacement timing, in the color priority mode, the image forming apparatus 100 separates all the photosensitive drums 201 from the intermediate transfer belt 200 when shifting to the low-power state. In the monochrome priority mode, when shifting to the low-power state, the image forming apparatus 100 brings only the photosensitive drum 201K into contact with the intermediate transfer belt 200 and separates other photosensitive drums 201Y, 201M, and 201C from the intermediate transfer belt 200. If at least one of the photosensitive drums 201Y, 201M, and 201C reaches the replacement timing, it is expected that the replacement work is carried out even if the image forming apparatus is in a low-power state period. In the color priority mode, occurrence of friction caused between the two of them at the time of replacement is avoided by bringing the image forming apparatus into the all-color separating state. In the monochrome priority mode, occurrence of friction caused at the time of replacing the photosensitive drums 201Y, 201M, and 201C, which are to be replaced, can be avoided even in the one-color contacting state so that only the photosensitive drum 201K is brought into contact with the intermediate transfer belt 200.

Figure 7:
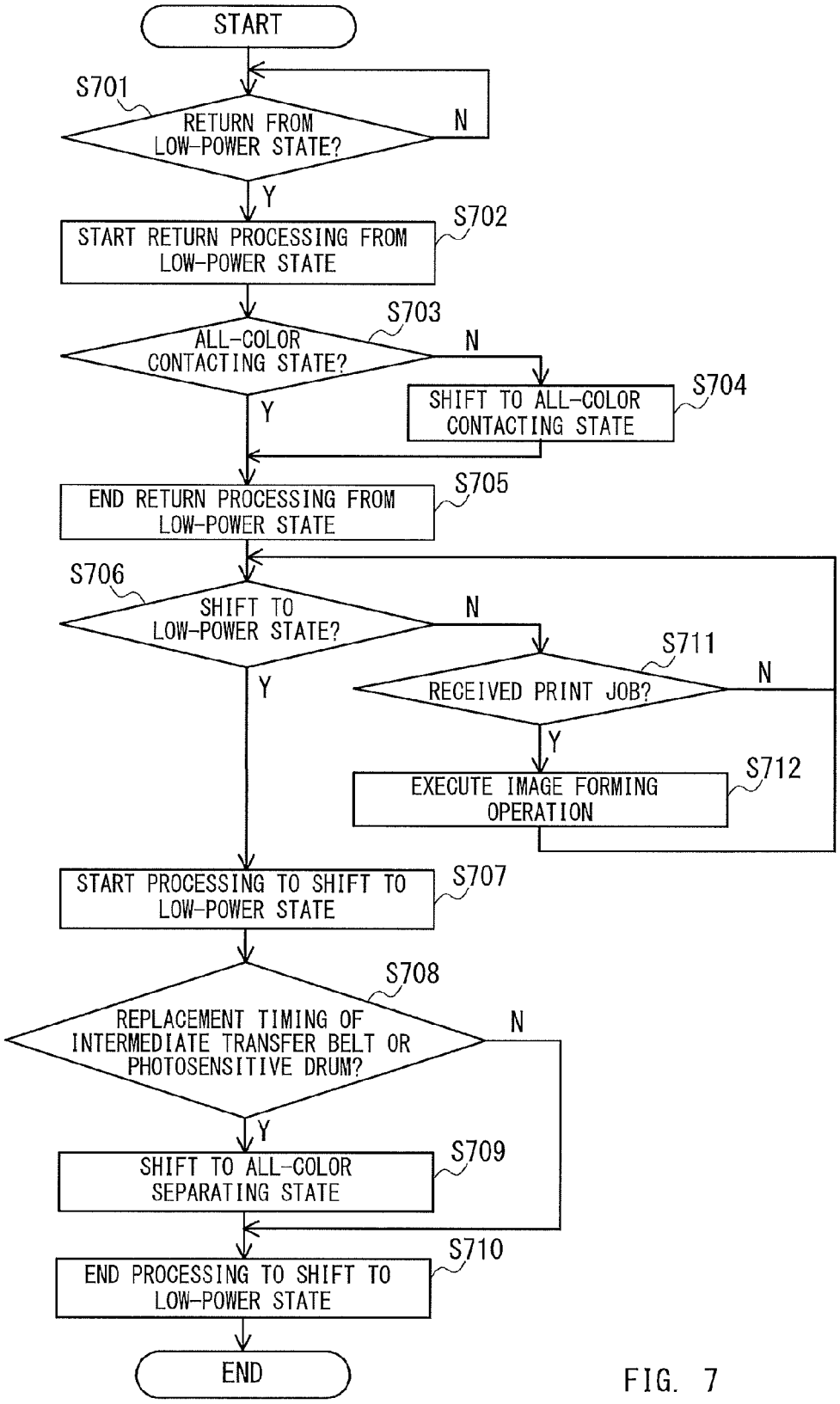
FIG. 7 is a flowchart representing processing to control the contacting state and separating state of the photosensitive drum in the color priority mode.

FIG. 7 is a flowchart representing processing to control the contacting/separating state of the photosensitive drum 201 when the color priority mode is selected. When the processing is started, the image forming apparatus 100 is in the low-power state.

The CPU 601 determines whether to perform return from the low-power state or not based on presence/absence of user's operation to an operation panel (S701). If there is the operation to the operation panel, the CPU 601 determines to perform return from the low-power state (S701: Y) and starts return processing (S702).

Based on the detection result of the separation sensor 606, the CPU 601 confirms the contacting/separating state of the intermediate transfer belt 200. If the intermediate transfer belt 200 is in the all-color contacting state (S703: Y), the CPU 601 ends the return processing from the low-power state (S705). If the intermediate transfer belt 200 is not in the all-color contacting state (S703: N), the CPU 601 drives the separation motor 604 to shift the intermediate transfer belt 200 to the all-color contacting state (S704) and ends the return processing from the low-power state (S705). When the return processing from the low-power state is ended, the image forming apparatus 100 enters the standby state. It is noted that, when returning from the low-power state, "the intermediate transfer belt 200 is not in the all-color contacting state" means that the intermediate transfer belt 200 or the photosensitive drum 201 reaches the replacement timing (described later) and the intermediate transfer belt 200 is brought into the all-color separating state when shifting to the low-power state (see FIG. 6).

When the image forming apparatus 100 enters the standby state, the CPU 601 determines whether there is no operation to the operation panel for a predetermined time or not. If there is any operation (S706: N), the CPU 601 performs processing according to the operation. If it is an input of print job (S711: Y), the CPU 601 executes an image forming operation (S712). If it is not an input of print job (S711: N), the CPU 601 determines again whether or not there is no operation to the operation panel for a predetermined time. Here, in the standby state, the intermediate transfer belt 200 is standing by in the all-color contacting state so that switching to the all-contacting operation will not be needed at the time of image forming operation, which enables to reduce downtime and prevents occurrence of noise accompanied by the operation. Further, even after the image forming operation, the all-color contacting state is maintained so that the same effect is obtained at the time of next image formation. On the other hand, if there is no operation to the operation panel (S706: Y), the CPU 601 starts processing to shift to the low-power state (S707). It is noted that the "predetermined time" is stored in the ROM 608 beforehand.

The CPU 601 determines whether the intermediate transfer belt 200 or the photosensitive drum 201 has reached the replacement timing or not (S708). The determination is made depending on, for example, an amount used from a default setting of the image forming apparatus 100 which is stored in the backup RAM 611, or an amount used from previous replacement of the intermediate transfer belt 200 or the photosensitive drum 201. The amount used is represented, for example, by integrated number of printings and integrated use time (integrated rotation time) corresponding to a lifetime. When the integrated number of printings stored in the ROM 608 is equal to or more than predetermined printings, the CPU 601 determines that the replacement timing has been reached. Alternatively, when the integrated use time exceeds predetermined time stored in the ROM 608, the CPU 601 determines that the replacement timing has been reached.

If the intermediate transfer belt 200 or the photosensitive drum 201 has reached the replacement timing (S708: Y), the CPU 601 drives the separation motor 604 to shift to the all-color separating state (S709). By the fact of having reached the replacement timing, it is assumed that the intermediate transfer belt 200 or the photosensitive drum 201 has reached the lifetime of the product. The part having reached the replacement timing may be replaced by the user. By bringing, by the CPU 601, the intermediate transfer belt 200 and the photosensitive drum 201 into the all-color separating state, it is possible to avoid a situation in which replacement is carried out with the intermediate transfer belt 200 brought into contact with the photosensitive drum 201. After shifting to the all-color separating state or if neither the intermediate transfer belt 200 nor the photosensitive drum 201 has reached the replacement timing (S708: N), the CPU 601 ends processing to shift to the low-power state (S710).

Figure 8:
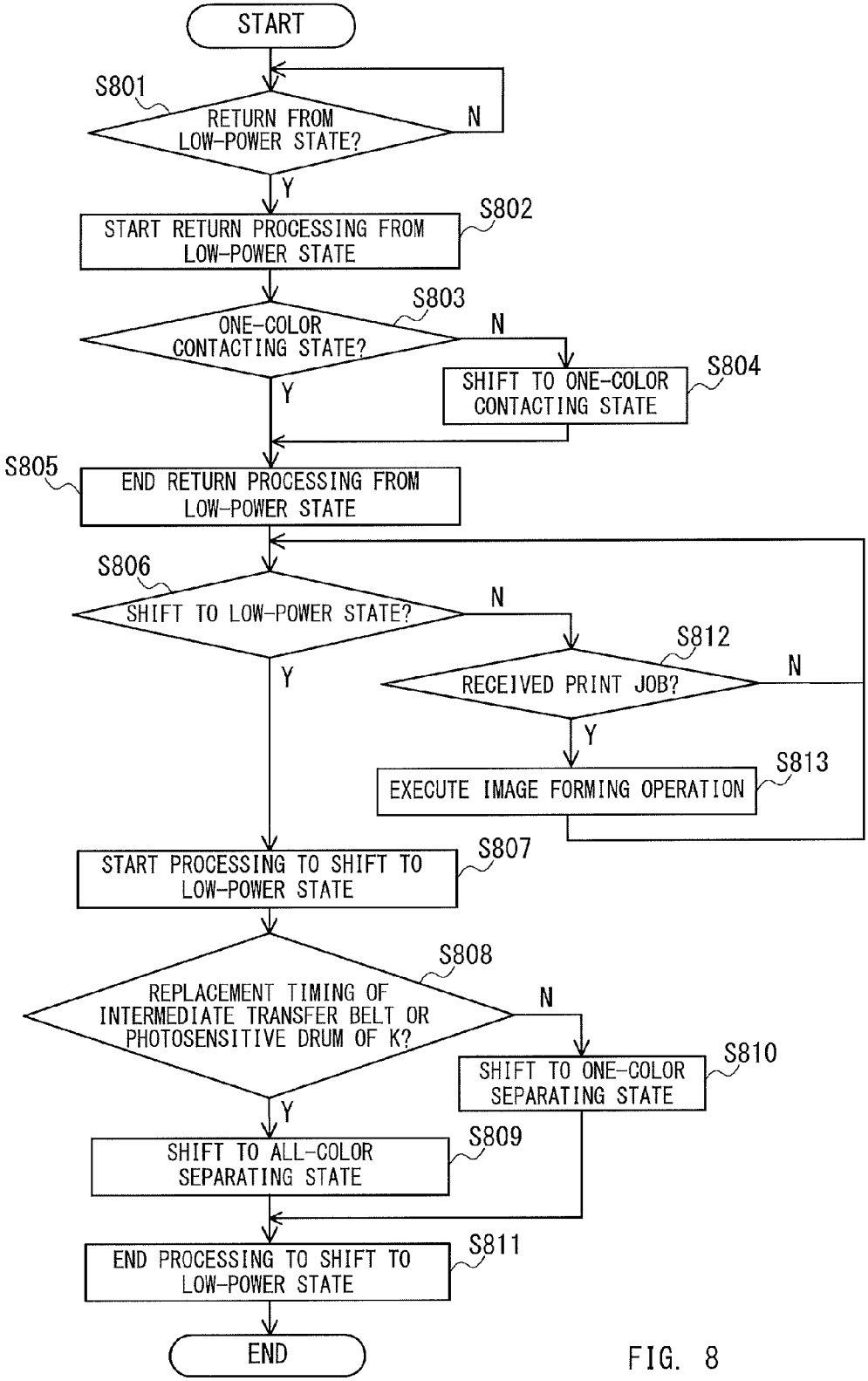
FIG. 8 is a flowchart representing processing to control the contacting state and the separating state of the photosensitive drum in the monochrome priority mode.

FIG. 8 is a flowchart representing processing to control the contacting/separating state of the photosensitive drum 201 when the monochrome priority mode is selected. When the processing is started, the image forming apparatus 100 is in the low-power state.

Similar to the processing performed when the color priority mode is selected, the CPU 601 determines whether to perform return from the low-power state or not. This is performed based on presence/absence of user's operation input to an operation panel (S801). If there is the operation to the operation panel, the CPU 601 determines to perform return from the low-power state (S801: Y) and starts return processing (S802).

Based on the detection result of the separation sensor 606, the CPU 601 confirms the contacting/separating state of the intermediate transfer belt 200. As the result of the confirmation, if the intermediate transfer belt 200 is in the one-color contacting state (S803: Y), the CPU 601 ends the return processing from the low-power state (S805). If the intermediate transfer belt 200 is not in the one-color contacting state (S803: N), the CPU 601 drives the separation motor 604 to shift the intermediate transfer belt 200 to the one-color contacting state (S804) and ends the return processing from the low-power state (S805). When the return processing from the low-power state is ended, the image forming apparatus 100 enters the standby state. It is noted that, when returning from the low-power state, "the intermediate transfer belt 200 is not in the one-color contacting state" means that the intermediate transfer belt 200 or the photosensitive drum 201 reaches the replacement timing (described later) and the intermediate transfer belt 200 is brought into the all-color separating state when shifting to the low-power state (see FIG. 6).

When the image forming apparatus 100 enters the standby state, the CPU 601 determines whether or not there is no operation to the operation panel for a predetermined time. If there is any operation (S806: N), the CPU 601 performs processing according to the operation. If it is an input of print job (S812: Y), the CPU 601 executes an image forming operation (S813). If it is not an input of print job (S812: N), the CPU 601 determines again whether or not there is no operation to the operation panel for a predetermined time. Here, in the standby state, the intermediate transfer belt 200 is standing by in the one-color contacting state so that switching to the one-contacting operation will not be needed at the time of the monochrome image forming operation, which enables to reduce downtime and prevents occurrence of noise accompanied by the operation. Further, even after the image forming operation, the one-color contacting state is maintained so that the same effect is obtained at the time of next monochrome image formation. On the other hand, if there is no operation to the operation panel (S806: Y), the CPU 601 starts processing to shift to the low-power state (S807). The CPU 601 determines whether the intermediate transfer belt 200 or the photosensitive drum 201K has reached the replacement timing or not (S808). Similar to the processing of S708 in FIG. 7, the replacement timing is determined.

If the intermediate transfer belt 200 or the photosensitive drum 201 has reached the replacement timing (S808: Y), the CPU 601 drives the separation motor 604 to shift to the all-color separating state (S809). By the fact of having reached the replacement timing, it is assumed that the intermediate transfer belt 200 or the photosensitive drum 201 has reached the lifetime of the product. The part having reached the replacement timing may be replaced by the user. By bringing, by the CPU 601, the intermediate transfer belt 200 and the photosensitive drum 201 into the all-color separating state, it is possible to avoid a situation in which replacement is carried out with the intermediate transfer belt 200 brought into contact with the photosensitive drum 201.

If neither the intermediate transfer belt 200 nor the photosensitive drum 201K has reached the replacement timing (S808: N), the CPU 601 drives the separation motor 604 to shift to the one-color separating state (S810). As the monochrome priority mode is selected, the intermediate transfer belt 200 is brought into the one-color separating state. Further, in a case where any one of the photosensitive drums 201Y, 201M, and 201C has reached the replacement timing, as the intermediate transfer belt 200 is brought into contact only with the photosensitive drum 201K, it is possible to avoid a situation in which replacement is carried out with the part to be replaced brought into contact with the intermediate transfer belt 200. The CPU 601 shifts to the all-color separating state or the one-color separating state and ends the processing to shift to the low-power state (S811).

In the above processing, description has given in a case where the image forming apparatus 100 returns from the low-power state and shifts thereafter again to the low-power state. In addition to this, the contacting/separating state of the photosensitive drum 201 may be changed by a power-off, through which power supply to the image forming apparatus 100 is interrupted. Alternatively, the contacting/separating state of the photosensitive drum 201 may be changed according to a state of a cover which is opened and closed when replacing the photosensitive drum 201 or the intermediate transfer belt 200. In this case, when the cover is in opened, the contacting/separating state of the photosensitive drum 201 is changed. By bringing the intermediate transfer belt 200 into the separating state, any unnecessary separating operation is suppressed. The intermediate transfer belt 200 is brought into the separating state when the image forming apparatus is in the low-power state, power-off state or in the state in which the cover of the image forming apparatus is opened, during which the photosensitive drum 201 or the intermediate transfer belt 200 is replaceable.

Further, influence to the image forming apparatus 100 main body is reduced so that good state can be maintained.

Recently, time to shift to the low-power state from the end of the image formation is reduced. Therefore, it is often the case that the image forming apparatus 100 shifts to the low-power state while the user prepares to replace the intermediate transfer belt 200 or the photosensitive drum 201. Thus, if the intermediate transfer belt 200 or the photosensitive drum 201 reaches the replacement timing when the image forming apparatus 100 shifts to the low-power state, the image forming apparatus 100 separates the two of them to avoid occurrence of friction caused therebetween at the time of replacement. The image forming apparatus 100 of this kind can realize the replacement of the intermediate transfer belt 200 or the photosensitive drum 201 by reducing any unnecessary mechanism or operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234383, filed Nov. 19, 2014, and No. 2015-204646, filed Oct. 16, 2015, which are hereby incorporated by reference herein in their entirety.

What is claimed is:

1. An image forming apparatus comprising:

first and second photoreceptors, on which toner images are formed and which are replaceable, the first photoreceptor being used for monochrome image formation and the second photoreceptor not being used for the monochrome image formation;

an intermediate transfer member, to which the toner images are transferred from the first and second photoreceptors, which is replaceable, and which is configured to operate in contact with the first and second photoreceptors;

a driving unit configured to move the intermediate transfer member in a direction toward the first and second photoreceptors and in a direction away from the first and second photoreceptors;

a storing unit configured to store information representing replacement timing of the first and second photoreceptors and the intermediate transfer member;

a control unit configured to cause the driving unit to separate the intermediate transfer member from the first and second photoreceptors in a case where the information represents that at least one of the first and second photoreceptors and the intermediate transfer member has reached the replacement timing and the image forming apparatus shifts to a low-power state in which power consumption of the image forming apparatus is suppressed compared with that of the image forming apparatus in a normal operation; and first and second transfer rollers which are positioned to face the first and second photoreceptors, respectively, interposed by the intermediate transfer member, and which are movable in a direction toward the respective first and second photoreceptors and in a direction away from the respective first and second photoreceptors, wherein the driving unit brings the intermediate transfer member into contact with the first and second photoreceptors by moving the respective first and second transfer rollers in the direction toward the respective first and second photoreceptors and separates the intermediate transfer member from the respective first and second photoreceptors by moving the respective first and second transfer rollers in the direction away from the respective first and second photoreceptors, wherein the control unit is further configured to cause the driving unit to separate the intermediate transfer member from the second photoreceptor and bring the intermediate transfer member into contact with the first photoreceptor in a case where the information represents that the second photoreceptor has reached the replacement timing and the image forming apparatus shifts to the low-power state.

2. The image forming apparatus according to claim 1, wherein the control unit is further configured to cause the driving unit to separate the intermediate transfer member and the respective first and second photoreceptors from each other when a power source of the image forming apparatus is turned off.

3. The image forming apparatus according to claim 1, wherein the control unit is further configured to cause the driving unit to separate the intermediate transfer member and the respective first and second photoreceptors from each other in a case where a cover, which is opened and closed when replacing at least one of the first and second photoreceptors and the intermediate transfer member, is in an open state.

4. The image forming apparatus according to claim 1, further comprising a selection unit configured to select monochrome image formation and color image formation, wherein the control unit is further configured to cause the driving unit to separate the intermediate transfer member from the second photoreceptor and to bring the intermediate transfer member into contact with the first photoreceptor in a case where the monochrome image formation is selected by the selection unit, the information represents that the second photoreceptor has reached the replacement timing, and the image forming apparatus shifts to the low-power state.

5. The image forming apparatus according to claim 1, wherein the control unit is further configured to cause the driving unit to separate the intermediate transfer member from the first photoreceptor and the second photoreceptor in a case where the information represents that the first photoreceptor has reached the replacement timing and the image forming apparatus shifts to the low-power state.

6. The image forming apparatus according to claim 1, wherein the control unit is further configured to determine that the replacement timing has been reached in a case where a usage amount of one of the first and second photoreceptors or the intermediate transfer member has reached a usage amount corresponding to a product lifetime.

7. The image forming apparatus according to claim 1, wherein:

the storing unit stores the number of sheets having the images formed thereon by the image forming apparatus as the information, and the control unit is further configured to determine that the replacement timing has been reached in a case where the number of sheets is equal to or more than predetermined number of sheets.

8. The image forming apparatus according to claim 1, wherein:

the storing unit stores a use time of the first and second photoreceptors and the intermediate transfer member by the image forming apparatus as the information; and wherein the control unit is further configured to determine that the replacement timing has been reached in a case where the use time exceeds a predetermined time.

9. An image forming apparatus having a first state, and a second state in which power consumption is lower than that of the first state, comprising:

a first image forming unit configured to form a first image on a first photosensitive member;

a second image forming unit configured to form a second image on a second photosensitive member;

an intermediate transfer member on which the first image and the second image are transferred;

a transfer unit configured to transfer the first image and the second image on the intermediate transfer member to a sheet;

a controller configured to select a mode among a plurality of modes, each of which defines a position relation among the first photosensitive member, the second photosensitive member and the intermediate transfer member, and to control the position relation based on the selected mode; and a determining unit configured to determine whether it is necessary to replace the first photosensitive member or not, and to determine whether it is necessary to replace the intermediate transfer member, wherein the plurality of modes comprise:

(i) a first mode in which the first photosensitive member and the intermediate transfer member are in contact with each other and the second photosensitive member and the intermediate transfer member are separated;

(ii) a second mode in which the first photosensitive member and the intermediate transfer member are in contact with each other and the second photosensitive member and the intermediate transfer member are in contact with each other;

(iii) a third mode in which the first photosensitive member and the intermediate transfer member are separated and the second photosensitive member and the intermediate transfer member are separated, wherein the controller is configured to select, based on a determination in the determining unit, a mode for controlling the position relation in the second state, wherein, in a case where neither the first photosensitive member nor the intermediate transfer member is determined to be replaced, the controller is configured to control the position relation in the second state based on the first mode, and wherein, in a case where at least one of the first photosensitive member and the intermediate transfer member is determined to be replaced, the controller is configured to control the position relation in the second state based on the third mode.

10. The image forming apparatus according to claim 9, wherein the determining unit is further configured to determine whether it is necessary to replace the second photosensitive member or not.

11. The image forming apparatus according to claim 9, further comprising a sensor for detecting the position relation.

12. The image forming apparatus according to claim 9, wherein the controller is further configured to control, in a case where the second state is changed to the first state, the position relation based on the first mode.

13. The image forming apparatus according to claim 9, further comprising an input unit configured to receive information for setting an image forming condition, wherein in a case where the input unit receives the information for setting the image formation condition, the second state is changed to the first state.

14. The image forming apparatus according to claim 9, wherein the determining unit determines whether it is necessary to replace the first photosensitive member or not based on a number of printings.

15. The image forming apparatus according to claim 9, wherein the determining unit determines whether it is necessary to replace the intermediate transfer member or not based on a number of printings.

16. The image forming apparatus according to claim 9, wherein the determining unit determines whether it is necessary to replace the first photosensitive member or not based on driving time of the first photosensitive member.

17. The image forming apparatus according to claim 9, wherein the determining unit determines whether it is necessary to replace the intermediate transfer member or not based on driving time of the intermediate transfer member.

18. The image forming apparatus according to claim 9, wherein the first image forming unit is configured to form the first image using black toner, and the second image forming unit is configured to form the second image using toner having a color other than black.

* * * * *